US006283204B1

(12) United States Patent
Brady et al.

(10) Patent No.: US 6,283,204 B1
(45) Date of Patent: Sep. 4, 2001

(54) OIL AND GAS PRODUCTION WITH DOWNHOLE SEPARATION AND REINJECTION OF GAS

(75) Inventors: Jerry L. Brady; Mark D. Stevenson; John M. Klein; James L. Cawvey, all of Anchorage, AK (US)

(73) Assignee: Atlantic Richfield Company, Los Angeles, CA (US)

( * ) Notice: Subject to any disclaimer, the term of this patent is extended or adjusted under 35 U.S.C. 154(b) by 0 days.

(21) Appl. No.: 09/393,382

(22) Filed: Sep. 10, 1999

(51) Int. Cl.[7] ..... E21B 43/38
(52) U.S. Cl. ..... 166/105.5; 166/265
(58) Field of Search ..... 166/265, 105.5, 166/105.6, 306

(56) References Cited

U.S. PATENT DOCUMENTS

| | | | | |
|---|---|---|---|---|
| 4,531,593 | | 7/1985 | Elliott et al. | 175/71 |
| 5,431,228 | | 7/1995 | Weingarten et al. | 166/357 |
| 5,482,117 | | 1/1996 | Kolpak | 166/265 |
| 5,605,193 | | 2/1997 | Bearden et al. | 166/370 |
| 5,662,167 | | 9/1997 | Patterson et al. | 166/265 |
| 5,794,697 | | 8/1998 | Wolflick et al. | 166/265 |
| 6,026,901 | * | 2/2000 | Brady et al. | 166/265 |

* cited by examiner

*Primary Examiner*—William Neuder
(74) *Attorney, Agent, or Firm*—Drude Faulconer

(57) ABSTRACT

A system for producing a mixed gas-oil stream which contains solid particulates wherein gas is to be separated and compressed downhole in a turbine-driven compressor before the gas is injected into a subterranean formation. The stream is passed through a first separator to separate out the particulates which are then passed through a bypass in the turbine without contacting the rotary vanes of the turbine thereby alleviating the erosive effects of the solids.

9 Claims, 2 Drawing Sheets

OIL AND GAS PRODUCTION WITH DOWNHOLE SEPARATION AND REINJECTION OF GAS

DESCRIPTION

1. Technical Field

The present invention relates to separating, compressing, and reinjecting a portion of the gas from the oil-gas stream produced from a subterranean zone and in one aspect relates to a method and subsurface system for separating a portion of the gas from a gas-oil production stream, passing the separated gas through a downhole turbine-compressor unit to compress and reinject the separated gas into a downhole formation wherein particulate material (e.g. sand) is also separated from the production stream and is by-passed around the turbine to prevent damage thereto.

2. Background

It is well known that many hydrocarbon reservoirs produce extremely large volumes of gas along with crude oil and other formation fluids, e.g. water. In producing fields such as these, it is not unusual to experience gas-to-oil ratios (GOR) as high as 25,000 standard cubic feet per barrel (scf/bbl.) or greater. As a result, large volumes of gas must be separated out of the liquids before the liquids are transported to storage for further processing or use. Where the production sites are near or convenient to large markets, this gas is considered a valuable asset when demands for gas are high. However, when demands are low or when a producing reservoir is located in a remote area, large volumes of produced gas can present major problems since production may have to be shut-in or at least drastically reduced if the produced gas can not be timely and properly disposed of.

In areas where substantial volumes of the produced gas can not be marketed or otherwise utilized, it is common to "reinject" the gas into a suitable, subterranean formation. For example, it is well known to inject the gas back into a "gas cap" zone which often overlies a production zone of a reservoir to maintain the pressure within the reservoir and thereby increase the ultimate liquid recovery therefrom. In other applications, the gas may be injected into a producing formation through an injection well to drive the hydrocarbons ahead of the gas towards a production well. Still further, the produced gas may be injected and "stored" in an appropriate, subterranean permeable formation from which it can be recovered later when the situation dictates.

To reinject the gas, large and expensive separation and compression surface facilities must be built at or near the production site. A major economic consideration in such facilities is the relatively high cost of the gas compressor train which is needed to compress and raise the large volumes of produced gas to the pressures required for reinjection. As will be understood in this art, significant cost savings can be achieved if these gas compressor requirements can be down-sized or eliminated altogether. To achieve this, however, it is necessary to either raise the pressure of the gas at the surface by some means other than mechanical compression or else reduce the pressure required at the surface for reinjection of the gas downhole or reduce the volume of gas actually produced to the surface.

Various methods and systems have been proposed for reducing some of the separating/handling steps normally required at the surface to process and/or re-inject at least a portion of the produced gas. These methods all basically involve separating at least a portion of the produced gas from the production stream downhole and then handling the separated gas and the remainder of the production stream separately from each other.

For example, one such method involves the positioning of an "auger" separator downhole within a production wellbore for separating a portion of the gas from the production stream as the stream flows upward through the wellbore; see U.S. Pat. No. 5,431,228, issued Jul. 11, 1998. Both the remainder of the production stream and the separated gas are flowed to the surface through separate flowpaths where each is individually handled. While this downhole separation of gas reduces the amount of separation which would otherwise be required at the surface, the gas which is separated downhole still requires substantially the same amount of compressor horsepower at the surface to process/reinject the gas as that which would be required if all of the gas in the production stream had been separated at the surface.

Another system involving the downhole separation of gas from a production stream is fully disclosed and claimed in U.S. Pat. No. 5,794,697, issued Aug. 18, 1998 wherein a subsurface processing and reinjection compressor (SPARC) is positioned downhole in the wellbore. The SPARC includes an auger separator which first separates at least a portion of the gas from the production stream (i.e. approximately half) and then compresses the separated gas by passing it through a compressor which, in turn, is driven by a turbine.

The remainder of the production stream (i.e. approximately the other half of the gas and the liquids) is routed through the turbine to act as the power fluid for driving the turbine. The compressed gas is not produced to the surface but instead is injected directly from the compressor into a second formation (e.g. gas cap) within the production wellbore. Since the remainder of the production stream is likely to also contain solid particulate material (e.g. produced sand), it can seriously erode the vanes of the turbine as it flows therethrough thereby substantially shortening the operational life of the SPARC.

Another system utilizing a SPARC, positioned downhole within a production well, is disclosed in co-pending and commonly-assigned, U.S. patent application Ser. No. 09/282,056, filed Mar. 29, 1999. In this system, the SPARC separates and compresses a portion of the gas in the production stream basically in the same manner as described above, but instead of re-injecting the compressed gas, both the compressed gas and the remainder of the production stream are produced to the surface through separate flowpaths. Again, substantially all of any solid particulates in the production stream has to pass through the turbine thereby causing possible erosion within the turbine.

Still another similar system is disclosed in co-pending and commonly-assigned, U.S. patent application Ser. No. 09/028,624, filed Feb. 24, 1998. In this downhole separation system, the entire production stream is first flowed through the turbine to drive the turbine before the stream is flowed through an auger separator which, in turn, is positioned above the turbine. A portion of the gas in the production is then separated by the auger and is passed through a compressor which, in turn, is driven by the turbine. The compressed gas is then injected into a formation adjacent the wellbore. Since the entire production stream flows through the turbine, this system is exposed to the same erosion problems as those discussed above.

As can be seen from the above, it is desirable to separate out as much as possible of the solid particulate material from the production stream before the stream is passed through the downhole turbine of a SPARC or like system in order to alleviate erosion of the turbine vanes. One such system is disclosed and claimed in co-pending and commonly-assigned, U.S. patent application Ser. No. 09/088,499, filed Jun. 1, 1998. A spiral groove or passageway is formed in the inner wall of the housing in which the auger separator is mounted. When the production stream flows through the auger separator, liquids are spun outwardly towards the inner wall of the housing.

The heavier portion of the liquids which contain most of any particulate material in the production stream collects in and flows through the spiral passageway which, in turn, empties into a by-pass passageway formed in the housing of the turbine whereby the portion of the stream containing the particulate material does not pass through the turbine. The present invention is directed to a similar system but has a different means for bypassing the turbine with the particulate-laden portion of the production stream.

SUMMARY OF THE INVENTION

The present invention provides a subsurface system for producing a mixed gas-oil stream to the surface from a subterranean zone through a wellbore wherein at least a portion of said gas is separated from said mixed gas-oil stream downhole and is compressed before the compressed gas is re-injected into a formation adjacent the wellbore. As will be understood in the art, the production stream will likely also include some water and some solids (e.g. sand, debris, etc.) which will be produced with the oil and gas so, as used herein, "mixed gas-oil stream(s)" is intended to include such production streams.

More specifically, the present system for producing a mixed gas-oil stream having liquid, gas, and solid particulates therein from a subterranean zone is comprised of a string of tubing extending from the subterranean zone to the surface. A first separator (e.g. auger separator) is positioned in the tubing and is adapted to separate at least a portion of said liquid and said solid particulates from said gas-oil stream as said stream flows upward through said tubing.

The first separator is comprised of a housing which has a spiral passageway formed in and along at least the upper portion of the inner wall of the housing which terminates in an outlet at the upper end of the housing. A central rod having an auger flight thereon extends substantially throughout the length of the housing whereby a spin will be imparted to the production stream as it flows through the first separator. At least some of the liquids and the solid particulates will be forced outward by centrifugal force towards the inner wall of the housing and into the spiral passage in the inner wall thereby leaving the remainder of the production stream flowing against the central rod.

A turbine is positioned above the first separator and is comprised of a housing which has an inlet and an outlet. A shaft is journaled in the housing and has a plurality of turbine vanes affixed to one end thereof which, in turn, are positioned between the inlet and outlet of the housing. The inlet of the turbine is adapted to receive the remainder of the production stream after at least a portion of the liquids and solid particulates have been separated therefrom as the stream passed through the first separator.

The turbine housing has a bypass passage therethrough which fluidly connects the turbine inlet to the outlet of the turbine housing. A conduit fluidly connects the outlet of the spiral passageway in the first separator housing to the bypass passage in the turbine housing so that the liquids and solids which collect in the spiral passageway in the first separator will flow through the conduit, through the bypass passage, and into the outlet of the turbine housing without passing through the turbine rotary vanes. This substantially reduces the erosive effects of the solid particulates in the production stream on the turbine rotary vanes and extends the operational life of the turbine.

The bypass passage may be formed by providing a passage in the shaft of the turbine having its inlet fluidly connected to the conduit from the spiral passageway and its outlet fluidly connected to the outlet in the turbine housing. Alternately, the bypass passage may be formed by a first bore in the turbine housing which fluidly connects the conduit from the spiral passageway to the inlet in the turbine housing and a second bore in the housing which fluidly connects the inlet and outlet of the turbine housing. The fluid and solids flow through the first bore, through the stationary vanes of the turbine, and through the second bore into the outlet of the turbine housing. In some instances, a short conduit may be used to span across the stationary vanes of the turbine to fluidly connect the first and second bores whereby the liquids and solid particulates from the spiral passageway can flow through the turbine housing without passing through the turbine rotary vanes. The outlet of the bypass passage is in fluid communication with the outlet of the turbine whereby the bypass fluids and solid particulates are recombined with the remainder of the stream after the stream has passed through the rotary turbine vanes.

The recombined stream flows into the inlet of a second separator which, in turn, is comprised of a central hollow tube having an auger flight thereon. One end of the tube is fluidly connected to the inlet of a compressor which, in turn, is positioned above the turbine and has compressor vanes which are driven by the shaft of the turbine. The other end of the tube has an inlet which allows gas which is separated by the second separator to enter the tube and flow into the compressor where it is compressed before it is reinjected into a formation adjacent the wellbore. The production stream, minus the separated gas, flows out of the second separator and into the production tubing through which it is then produced to the surface.

BRIEF DESCRIPTION OF THE DRAWINGS

The actual construction, operation, and apparent advantages of the present invention will be better understood by referring to the drawings which is not necessarily to scale and in which like numerals refer to like parts and in which.

BEST KNOWN MODE FOR CARRYING OUT THE INVENTION

Figure 1:
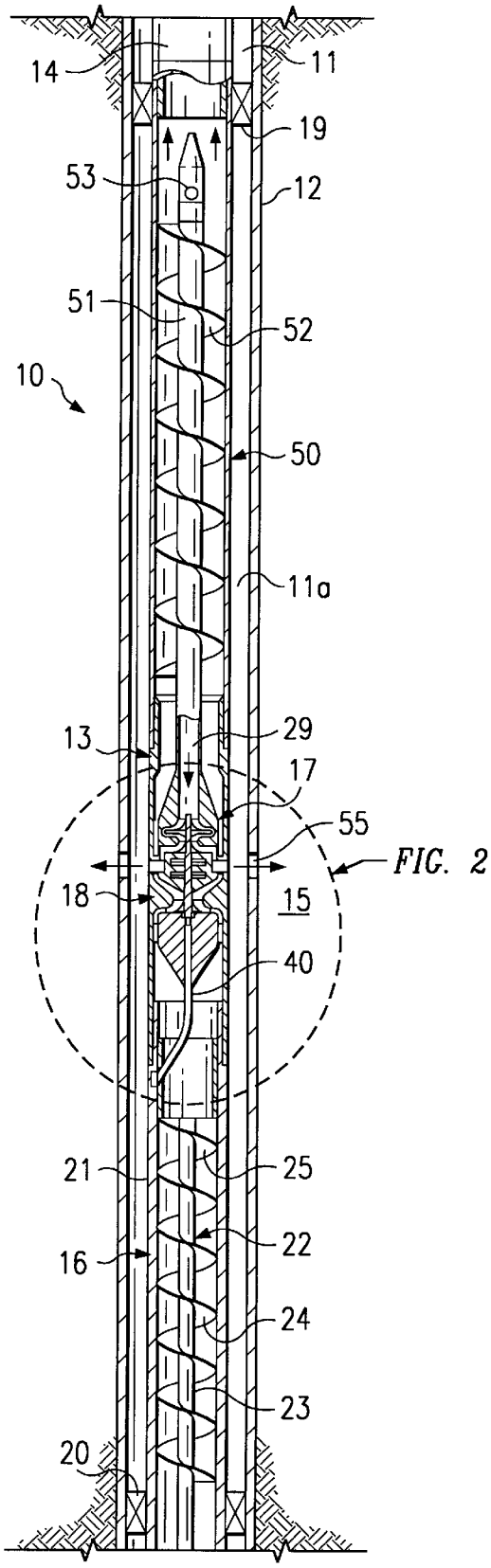
FIG. 1 is a cross-sectional view, partly broken away, of the subsurface separator-compressor system of the present invention when in an operable position within a production wellbore.

Referring more particularly to the drawings, FIG. 1 discloses a downhole section of production well 10 having a wellbore 11 which extends from the surface into and/or through a production zone (neither shown). As illustrated in FIG. 1, wellbore 11 is cased with a string of casing 12 which is perforated or otherwise completed (not shown) adjacent the production zone to allow flow of fluids from the production zone into the wellbore as will be fully understood by those skilled in the art.

Although the subsurface processing and reinjection compressor system 13 of the present invention has been illustrated as being assembled into a string of production tubing 14 and lowered therewith into the wellbore 11 to a position adjacent formation 15 (e.g. a gas cap above a production formation), it should be recognized the system 13 could be assembled as a unit and then lowered through the production tubing 14 by a wireline, coiled tubing string, etc. after the production tubing has been run into the wellbore 11. As shown, system 13 is basically comprised of four major components; a first separator section 16, compressor section 17, turbine section 18, and a second separator section 50. Packers 19, 20 are spaced between system 13 and casing 12 for a purpose described below.

The first separator section 16 is comprised of a separator housing 21 which, in turn, is fluidly connected at its lower end into production tubing string 14 to receive the flow of the production stream as it flows upward through the tubing. An auger separator 22 is positioned within the housing 21 and is adapted to impart a spin on the production stream as it flows therethrough for a purpose to be described later. As shown, auger separator 22 is comprised of a central rod or support 23 having a helical-wound, auger-like flight 24 secured thereto.

Auger separators of this type are known in the art and are disclosed and fully discussed in U.S. Pat. No. 5,431,228 which issued Jul. 11, 1995, and which is incorporated herein in its entirety by reference. Also, for a further discussion of the construction and operation of such separators, see "New Design for Compact-Liquid Gas Partial Separation: Down Hole and Surface Installations for Artificial Lift Applications", Jean S. Weingarten et al, SPE 30637, Presented Oct. 22–25, 1995 at Dallas, Tex.

In accordance with the present invention, separator housing 21 has a spiral groove or passageway 25 formed in the inner wall thereof. Spiral passageway 25 extends along at least the upper portion of housing 21 and its outlet 26 terminates at the upper end of housing 21. As best seen in FIGS. 4–7, spiral passageway 25 preferably narrows circumferentially ("c" in FIG. 6) but deepens radially ("r" in FIG. as it spirals upward from its origination point towards outlet 26 at the upper end of housing 21 for a purpose to be discussed below.

Figure 2:
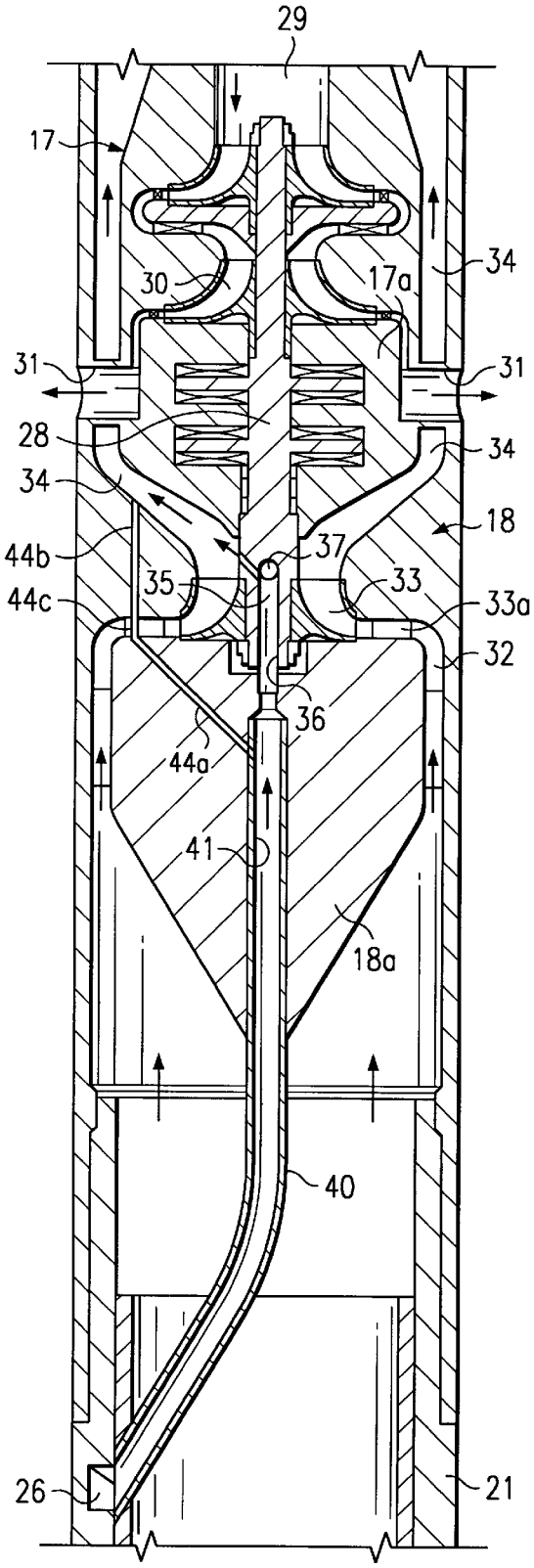
FIG. 2 is an enlarged, cross-sectional view of the present subsurface separator-compressor system taken within line 2—2 of FIG. 1.
Figure 3:
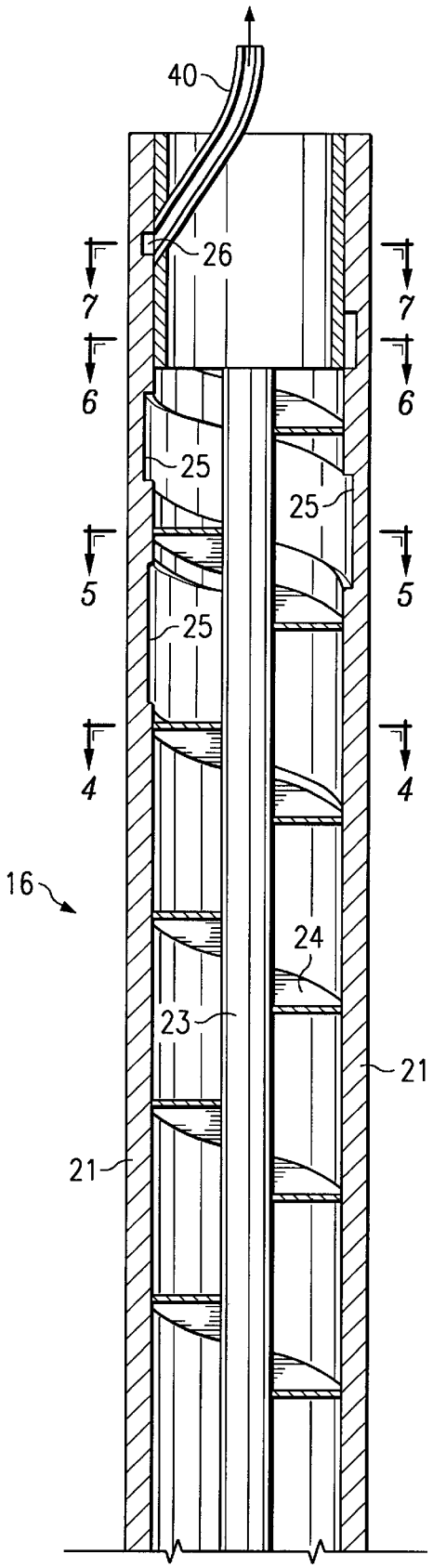
FIG. 3 is an enlarged, cross-sectional view of the auger separator of the subsurface separator-compressor system of FIG. 1.
Figure 4:
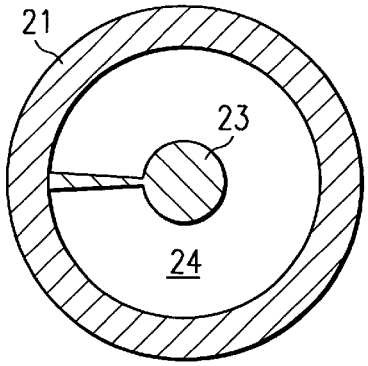
FIG. 4 is an enlarged, cross-sectional view taken along line 4—4 of FIG. 3.
Figure 5:
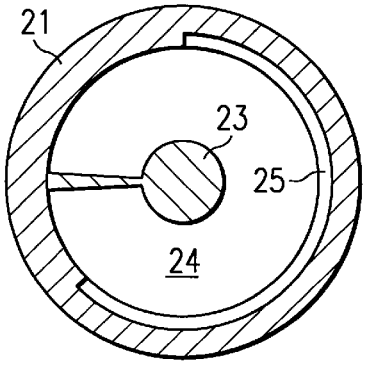
FIG. 5 is an enlarged, cross-sectional view taken along line 5—5 of FIG. 3.
Figure 6:
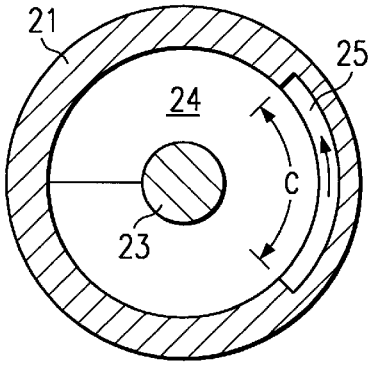
FIG. 6 is an enlarged, cross-sectional view taken along line 6—6 of FIG. 3.
Figure 7:
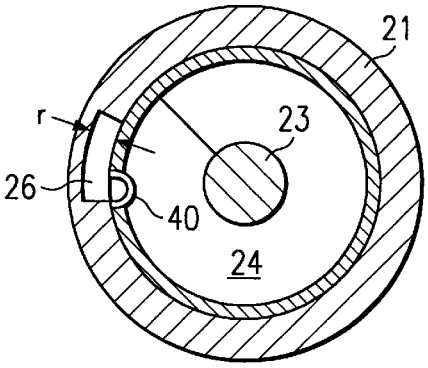
FIG. 7 is an enlarged, cross-sectional view taken along line 7—7 of FIG. 3.

Compressor section 17 and turbine section 18 are positioned above separator section 16 as shown in the figures. As best seen in FIG. 2, turbine section 18 is comprised of an inlet(s) 32, rotary vanes 33 mounted on shaft 28, stationary vanes 33*a*, and an outlet 34. Compressor section 17 is comprised of an inlet 29, rotary vanes 30 mounted on the other end of shaft 28, and an outlet(s) 31. Shaft 28 is journaled at one end in turbine housing 18*a* and is journaled along its length in intermediate support 17*a*. As will be understood, as a power fluid flows through turbine section 18, it will rotate vanes 33 which are attached to shaft 28, which, in turn, will rotate vanes 30 in compressor section 17 to thereby compress gas as it flows therethrough.

In accordance with the present invention, a bypass passageway is provided which will allow solid particulate-laden fluids to by-pass turbine 18 thereby alleviating the erosive effects of such fluids and solids. As best seen in FIG. 2, shaft 28 has an internal passage 35 therein which has an inlet 36 which, in turn, is fluidly connected to the outlet 26 of spiral passageway 25 in housing 21. As shown, a conduit 40 is connected at one end to the outlet 26 and at its other end to passage 41 in turbine housing 18*a* which, in turn, is fluidly connected to the inlet 36 of passage 35. Any fluids, including any solid particulate material, that collects in groove 25 will flow through conduit 40 into passage 36 and out outlet 37 into outlet(s) 34 of turbine 18, thereby bypass vanes 33 in turbine 18.

In addition to the bypass passage through shaft 28 or in lieu thereof, an alternate bypass passage may be provided for bypassing turbine 18. As illustrated in FIG. 2, alternate bypass passage is formed by a first bore 44*a* in turbine housing 18*a* which extends from passage 41 to turbine inlet 32; a second bore 44*b* which extends between turbine inlet 32 and turbine outlet 34. This allows particulate-laden fluid to flow from passage 41, through bore 44*a*, through the stationary vanes 33*a* of the turbine, and out bore 44*b* into turbine outlet 34 without passing through turbine rotary vanes 33. Alternately, a short conduit 44*c* may be used to span the stationary vanes 33*a* and directly connect bore 44*a* to bore 44*b*.

In operation, a mixed gas-oil stream from a subterranean, production zone (not shown) flows upward to the surface (not shown) through production tubing 14. As will be understood in the art, most mixed oil-gas streams will include some produced water so as used herein, "mixed oil-gas stream" is intended to include streams having some produced water therein. Also, it is not uncommon for most production streams to also include substantial amounts of solid particulate material (e.g. sand produced from the formation, rust and other debris, etc.).

As the mixed gas-oil stream flows upward through separator section 16, auger flight 24 of auger separator 22 will impart a spin on the stream wherein the heavier components of the stream (e.g. oil, water, and the solid particulates) in the stream are forced to the outside of the auger by centrifugal force while the gas remains near the wall of center rod 23. As the stream flows toward the upper end of separator housing 21, the heavier components (i.e. liquids and particulates) will collect and flow through spiral groove or passageway 25. When the heavier components reaches outlet 26 at the upper end of groove 25, they will flow through conduit 40, through passage 41, into passage 35 in shaft 28, and out into turbine outlet(s) 34, thereby bypassing turbine vanes 33. If the disclosed alternate passage is present, the particulate-laden fluid from conduit 40 will flow through passage 41, bore 44*a*, either directly through stationary vanes 33*a* or through conduit 44*c*, and out through bore 44*b* into turbine outlet(s) 34, again bypassing vanes 33 in turbine 18.

The remainder of gas-oil stream will flows into inlet(s) 32 of the turbine section 18 as it reaches the upper end of flight 24 to rotate vanes 33, shaft 28, and vanes 30 in compressor section 17. The remainder of the stream flows through outlet(s) 34 of the turbine section 18 where it is recombined with the particulate-laden stream from the bypass passage (s). The recombined stream, which is now essentially the original production stream, flows through the second separator section 50 which, in turn, is comprised of a central hollow tube 51 having an auger flight 52 thereon.

As the combined stream flows upward through the second separator 50, it will again be spun to force the heavier components, i.e. liquids and particulate material, outwardly by centrifugal force while a portion of the gas will separate and remain inside against the outer wall of central tube 51. As the gas reaches the upper end of tube 51, it flows into the tube through a first inlet 53. The gas then flows down through tube 51 into inlet 29 of compressor section 17 where it is compressed before it exits through outlet(s) 31 of the compressor. The compressed gas then flows into the space isolated between packers 19, 20 in annulus 11*a* and from there is injected into formation 15 through openings 55 (e.g. perforations) in casing 12. The liquids and unseparated gas along with the particulates will flow from the separator through a second outlet into the production tubing 14 through which it is then produced to the surface.

What is claimed is:

1. A subsurface system for producing a mixed gas-oil stream having liquids, gas, and solid particulates therein from a subterranean zone to the surface through a wellbore said system comprising:

a string of tubing positioned within said wellbore and extending from said subterranean zone to said surface;

a first separator positioned downhole in said tubing and adapted to separate at least a portion of said liquids and said solid particulates from said gas-oil stream as said stream flows upward through said tubing; said first separator comprising:

a housing in fluid communication with said tubing; said housing having an inner wall and a spiral passageway formed in at least said upper portion of the inner wall of said housing and terminating in an outlet at the upper end of said housing, a central rod extending substantially through said housing; and a means for imparting a spin to said gas-oil stream as it flows through said first separator to thereby separate at least some of said liquids and said solid particulates from said gas-oil stream by forcing said at least some liquids and said solid particulates outward towards said inner wall of said housing and into said spiral passageway leaving the remainder of said gas-oil stream to flow through the central portion of said housing;

a turbine positioned downhole within said tubing above said first separator, said turbine comprising:

a turbine housing having an inlet and an outlet;

a plurality of stationary vanes affixed within said inlet of said turbine housing;

a shaft rotatably mounted in said turbine housing;

a plurality of rotary vanes affixed to one end of said shaft;

said inlet adapted to receive said remainder of said gas-oil stream for rotating said rotary vanes and said shaft;

a bypass passage in said turbine housing fluidly connecting said inlet to said outlet of said turbine housing; and a conduit fluidly connecting said outlet of said spiral passageway in said first separator housing to said bypass passage in said turbine housing whereby said at least some liquids and said solid particulates flow from said spiral passageway through said bypass passage in said turbine housing.

2. The system of claim 1 wherein said bypass passage comprises:

a passage in said shaft, said passage having an inlet fluidly connected to said conduit and an outlet fluidly connected to said outlet of said turbine housing.

3. The system of claim 1 wherein said bypass passage comprises:

a first bore in said turbine housing for fluidly connecting said conduit to said inlet of said turbine housing;

a second bore in said turbine housing for fluidly connecting said inlet of said turbine housing to said outlet of said turbine housing; and means for fluidly connecting said first bore to said second bore.

4. The system of claim 2 wherein said means for connecting said first bore to said second bore comprises:

a passageway through the stationary vanes of said turbine.

5. The system of claim 1 wherein said means for imparting a spin to said gas-oil stream within said first separator comprises:

an auger flight on said central rod and extending substantially along the length thereof, whereby a spin will be imparted to said gas-oil stream as it flows through said first separator to thereby separate at least some of said liquids and said solid particulates from said gas-oil stream by forcing said at least some liquids and said solid particulates outward towards said inner wall of said housing and into said spiral passageway leaving the remainder of said gas-oil stream to flow against said central rod.

6. The system of claim 1 including:

a compressor positioned downhole in fluid communication with said tubing, said compressor comprising:

vanes mounted on the other end of said shaft adapted to be driven by said shaft; and an inlet adapted to receive gas from said gas-oil stream.

7. The system of claim 6 including:

a second separator positioned downhole above said compressor, said second separator having an inlet fluidly connected to said outlet of said turbine section and two outlets, the first of said outlets being fluidly connected to said inlet of said compressor and the second of said outlets being fluidly connected to said tubing string.

8. The system of claim 7 wherein said second separator further comprises:

a central hollow tube extending substantially through the length of said second separator; and an auger flight affixed to said central hollow tube and extending along substantially the length thereof; said hollow tube being fluidly connected to said inlet of said compressor at its lower end and having an opening near its upper end which comprises said first outlet of said second separator.

9. The system of claim 1 wherein said spiral passageway decreases circumferentially but increases radially as said passageway spirals upward from the originating point of said spiral passageway on said inner wall of said first separator housing toward the termination point of said spiral passageway at the upper end of said inner wall of said first separator housing.

* * * * *